United States Patent [19]

Tillander

[11] 4,374,464

[45] Feb. 22, 1983

[54] CORK MOUNTING APPARATUS

[76] Inventor: Bengt S. R. Tillander, Fröslunda, 190 70 Fjärdhundra, Sweden

[21] Appl. No.: 184,372

[22] Filed: Sep. 5, 1980

[30] Foreign Application Priority Data

Sep. 5, 1979 [SE] Sweden ..... 7907374

[51] Int. Cl.[3] ..... B67B 1/04; B67B 5/00; B65B 67/00

[52] U.S. Cl. ..... 53/324; 53/363; 53/390; 53/381 A; 81/3.1 A; 81/3.48

[58] Field of Search ..... 53/319, 381 A, 324, 53/326, 346, 356, 363, 322, 390, 201, 287; 81/3.1 A, 3.48

[56] References Cited

U.S. PATENT DOCUMENTS

| | | | |
|---|---|---|---|
| 35,325 | 5/1962 | Redlich | 53/324 |
| 324,963 | 8/1885 | Sommer | 53/324 |
| 1,257,637 | 2/1918 | Rice | 53/363 |
| 1,366,755 | 1/1921 | Vaughan | 53/363 |
| 1,409,585 | 3/1922 | Rouse | 53/363 |
| 1,421,698 | 7/1922 | Lebherz | 53/363 |
| 1,653,490 | 12/1927 | Ballou et al. | 81/3.1 A |
| 1,981,565 | 11/1934 | Namur | 53/319 X |
| 2,682,985 | 7/1954 | Colonna | 53/363 X |
| 2,815,630 | 12/1957 | Tonna et al. | 53/356 |

*Primary Examiner*—Horace M. Culver

*Attorney, Agent, or Firm*—Burns, Doane, Swecker & Mathis

[57] ABSTRACT

The present invention relates to a cork mounting apparatus for bottles which comprises two head parts, one lower part, and one upper part. The invention stands out from earlier well-known apparatus in that the upper part which includes a piston has an outer tube which is arranged around an outer wall of the lower part. Accordingly, the piston will therefore go straight up and down in a socket connected to the lower part. The lower part is also provided with a tube which extends down around the bottle-neck. The lower part tube eliminates wobbling of the bottle during the cork mounting operation. The apparatus is also useful for mounting capsules and foils on bottles. Also, with an extra fitting, the apparatus may be used as a corkscrew. The upper part may furthermore be used separately as a "doughy-free" closing plug for bottles.

10 Claims, 8 Drawing Figures

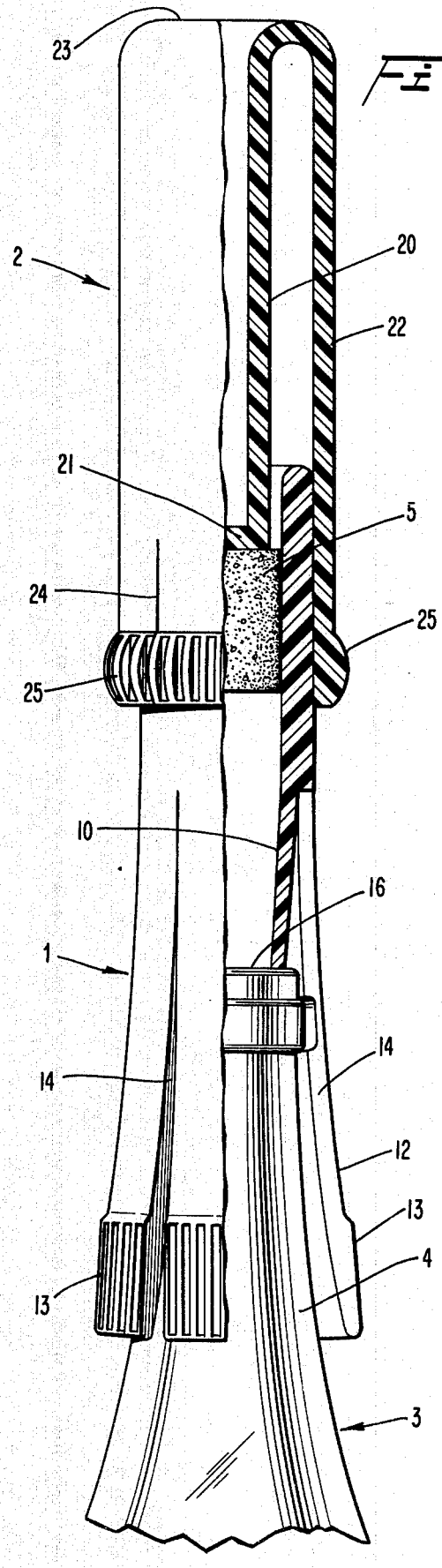
Fig. 1
Fig. 2
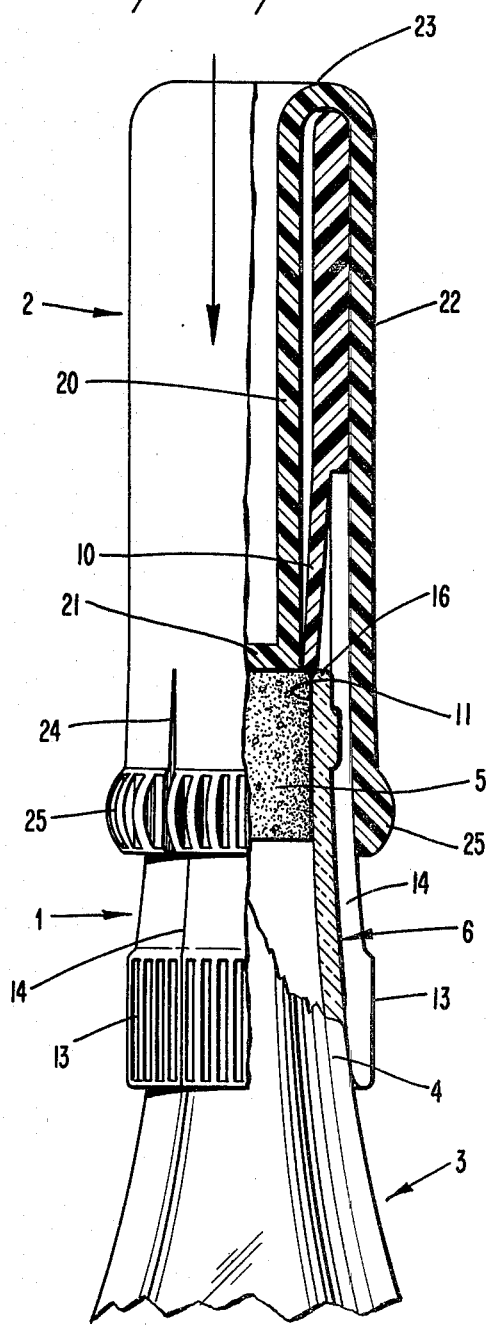

Fig. 3
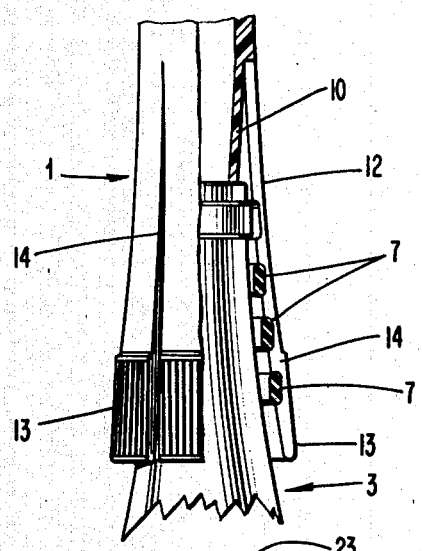
Fig. 4
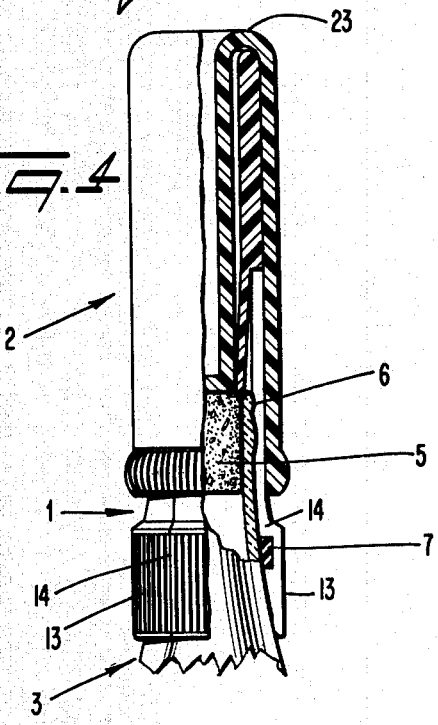
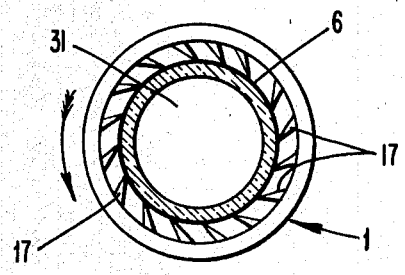
Fig. 5
Fig. 6
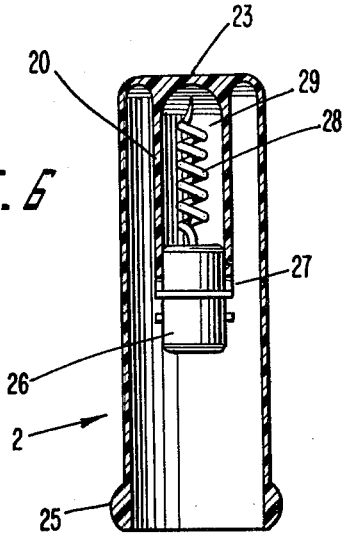
Fig. 7
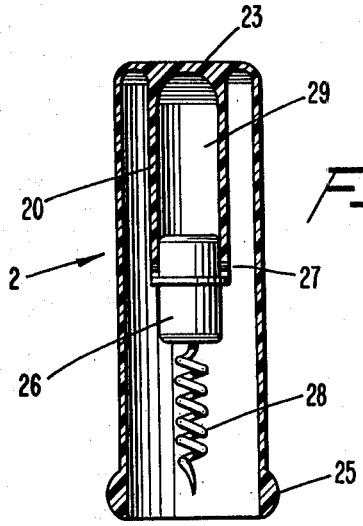
Fig. 8
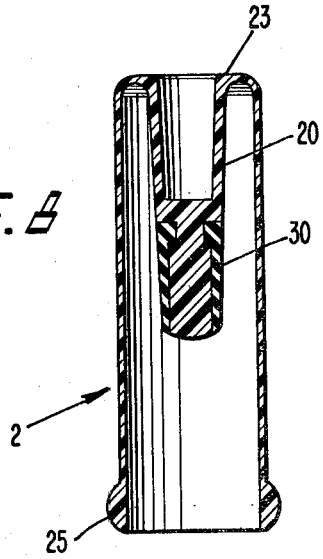

CORK MOUNTING APPARATUS

BACKGROUND OF THE PRESENT INVENTION

The present invention relates to a cork mounting apparatus for bottles. The present invention can also in an easy way be modified such that it can be used as well as a foil and capsule mounter or as a corkscrew. The upper part of the apparatus may also be used separately as an "doughy-free" closing plug for bottles.

An object of the present invention is consequently to produce a functional and inexpensive apparatus thought to be used especially in wine- and juice-makings.

Through the combination of several sub-operations with the help of just one arrangement, this invention is especially adapted for wine- or juice-makings at home.

BRIEF DESCRIPTION OF THE DRAWINGS

The present invention will be described in greater detail with reference to a preferred embodiment and the accompaning drawings in which like members bear like reference numerals and wherein:

FIG. 1 is a cross-sectional view of the apparatus with an input cork placed on the top of a bottle-neck and showing the moment when the cork mounting begins;

FIG. 2 is a cross-sectional view of the apparatus with a cork mounted in the bottle-neck furnished with a foil;

FIG. 3 is a cross-sectional view of the lower part of the apparatus furnished with three rubber rings in order to increase the fixing against the bottle-neck;

FIG. 4 is a cross-sectional view of the apparatus adapted for beer and lemonade bottles;

FIG. 5 is a horizontal sectional view of the apparatus furnished with a special foil-mounter;

FIG. 6 is a cross-sectional view of the upper part of the apparatus in which a corkscrew is arranged in the piston;

FIG. 7 is a view similar to FIG. 6 but with the corkscrew turned down; and

FIG. 8 is a cross-sectional view of the upper part of the apparatus where the piston is adapted to be used as a closing plug for bottles.

DETAILED DESCRIPTION OF THE PREFERRED EMBODIMENT

The invention includes only two head-parts, lower part (1) and an upper part(2) which through cooperation with each other make such an effect that the arrangement primarily will be used as a cork mounter but with a slight modification also may be used for mounting foils and capsules on bottles and with an extra fitting may be used as a corkscrew.

The lower part (1) consists of a hole or partially conic socket (10) which narrows toward a lower opening (11). The diameter of the lower opening has the same measure or a little less than a top (16) of a bottle-neck (4). With reference to FIG. 1, a cork (5) is arranged in the upper part of the socket (10).

Around the bottle-neck (4) is a tube (12) connected with the bottom part of the socket (10). The tube (12) is on its bottom part formed as a holder (13) adapted for use by one hand. The holder (13) closed around the bottle-neck provides a good fitting effect of the apparatus against the bottle and facilitates a reaching with a hand and holding around the bottle and the lower part (1). This arrangement eliminates wobbling risk of the apparatus against the bottle which wobbling often occurred with earlier well-known constructions.

To further strengthen the fitting effect of the apparatus against the bottle-neck, the tube (12) has a plurality of longitudinal slits (14) which make it possible to fix the tube (12) around the bottle-neck (4) with one hand via the holder (13). The lower part is preferably manufactured in a hard elastic material, for instance, acetalplastic or polypropylene. With reference to FIG. 1, the upper part (2) includes a piston (20) having a bottom (21) bearing on the top of the cork (5). The piston (20) is centrally arranged within the socket (10) by an outer tube (22) connected to the piston (20) which outer tube (22) is arranged around a cylindrical outer wall (15) of the lower part (1).

The outer tube (22) is preferably a little longer than the piston (20) so that the arrangement of the outer tube (22) over the lower part (1) is correct even if the cork (5) stretches out a bit over the top of the socket (10).

Since the piston (20) is connected with the outer tube (22) it is not necessary to furnish the apparatus with a special steering or aligning arrangement over the piston (20) which earlier well-known constructions have required. The outer tube (22) can be easily formed such that it gives a perfect hand-manipulation at the same time as it is possible to manufacture the apparatus small and compact.

The tube (12) is stretched with the holder (13) to surround the bottle-neck (4) and ensures a simple and sure cork mounting without wobbling. In addition, the configuration of the apparatus makes it easy and sure to use. This simplicity is due in part to the fact that the outer tube (22) together with the top part (23) is a very good holder for the hand.

With reference to FIG. 2, the apparatus may be used as a foil-mounter of a bottle. A foil (6) is mounted over the cork (5) which is plugged into the bottle-neck (4). The foil (6) will then be formed around the bottle-neck through the pinch of the holder (13) about the bottle-neck (4). An inside (16) of the lower part (1) is formed approximately in the shape of the bottle-neck and therefore will form the foil (6) closely against the bottle-neck.

To effectuate a very good mounting of the foil (6) it is possible to let the upper part (2) push down over the lower part (1) to the bottom. Then, through the slits (14), the elastic tube (12) will be pressed together around the bottle-neck (4) through the radial pressure from the outer tube (22). In this way, the foil (6) will closely surround the bottle-neck (4). After the foil mounting, the upper part (2) is removed and the elastic tube (12) expands such that the lower part (1) can be removed from the bottle-neck.

Because of a variable form and diameter of bottle-necks, the inside (16) of the lower part (1) is preferably provided with radially thin flanges (17) on the wall (16).

In order to make the foil mounting better especially the fitting effect around the bottle-neck when a cork is mounted, the inner wall (16) may be provided completely or partially with an elastic rubber film.

With reference to FIG. 3, a plurality of rubber rings (7) are fixed in peripheral rails in the expanded tube (12) in order to bring the lower part (1) closely together with the bottle.

If the lower part of tube (22) is furnished with some longitudinal slits (24), it is also much easier to use the apparatus when the form of the bottle-necks is variable. When the upper part (2) is pushed down around the lower part (1), the lower part (25) of the outer tube (22) will expand a little and the tube (12) will in that case be pressed against the foil (6) with a constant force even if the form of the bottle-necks is variable.

FIG. 4 is a view showing the apparatus adapted for use as a cork and capsule mounter for beer and lemonade bottles.

With reference to FIG. 5, a cross-sectional view seen from the bottom of another embodiment of a foil mounter includes the thin flanges (17) provided on an inside of the tube (12). These flanges (17) press with a constant force the foil against the bottle-neck (4) even if the form of the bottles change. To present a smooth surface on the foil, the apparatus can then be turned around the bottle-neck (4), so that the flanges continually press the foil against the bottle-neck.

The outer tube (22) which is utilized as a holder does not become doughy from wine or juice from the bottle hole. In other words, it is desirable to use the "upper part" as a doughy-free closing plug for an opened wine or juice bottle.

Of course, it is not necessary to use an elastic tube (30) if the piston is comprised of a material of sufficient elasticity.

The piston end part can, for example, also be furnished with an exchange stamp. It is for instance practical to notice the right year on the top of the foil.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A cork mounting apparatus for bottles comprising two cooperating parts, the cooperating parts including a lower part and an upper part axially movable relative to one another, a top of the lower part including an internal socket having a lower edge adapted to press against a top of a bottle-neck for guiding a cork, a movable piston connected with the upper part and arranged to urge the cork through said socket, the lower part including a surrounding tube which at least partially serves as a holder for the lower part, the piston being connected with an outer tube of the upper part which outer tube surrounds an outer wall of the lower part and provides a centering arrangement for the piston and the socket.

2. The cork mounting apparatus for bottles as claimed in claim 1, wherein the surrounding tube is provided with longitudinal slits which facilitate a fixing of the tube around the bottle-neck, said surrounding tube being provided with a holder.

3. The cork mounting apparatus for bottles as claimed in claim 1 or 2, wherein the outer tube extends downward from a bottom of the piston sufficiently far such that a centering of the outer tube around the lower part exists even when the cork is in an upper position in the socket.

4. The cork mounting apparatus for bottles as claimed in claim 2, wherein an inside of the surrounding tube is formed similar to the bottle-neck such that a foil or capsule arranged between the bottle-neck and the surrounding tube is formed and fixed on the bottle-neck by pressing together the surrounding tube around the bottle-neck.

5. The cork mounting apparatus for bottles as claimed in claim 4, wherein the outer tube in a bottom position over the lower part presses together the surrounding tube with a bottom part of the outer tube and also fixes the interposed foil or capsule around the bottle-neck.

6. The cork mounting apparatus for bottles as claimed in claim 1, wherein an inside wall of the surrounding tube is provided with elastic projections.

7. The cork mounting apparatus for bottles as claimed in claim 1, wherein an inside of the surrounding tube is provided at least partially with an elastomeric material.

8. The cork mounting apparatus for bottles as claimed in claim 1, wherein a lower part of the outer tube is furnished with a plurality of slits.

9. The cork mounting apparatus for bottles as claimed in claim 1, wherein the piston is conical and has a diameter equal to or slightly less than the diameter of the bottlehole, said piston being of an elastic material.

10. The cork mounting apparatus for bottles as claimed in claim 1, further comprising a plug connected to a lower portion of the piston, and a cork-screw fastened on one end of the plug.

* * * * *